US005445137A

United States Patent [19]

Crews

[11] Patent Number: 5,445,137

[45] Date of Patent: Aug. 29, 1995

[54] BACKPACKING STOVE FOR TENT USE

[76] Inventor: Paul B. Crews, 2300 Telequana Dr., Anchorage, Ak. 99517

[21] Appl. No.: 155,684

[22] Filed: Nov. 22, 1993

[51] Int. Cl.[6] ..... F24C 1/16

[52] U.S. Cl. ..... 126/59; 126/9 R; 126/85 B; 126/307 R; 126/314

[58] Field of Search ..... 126/59, 85 B, 85 R, 126/90 R, 93, 248, 91 R, 4, 6, 9 R, 307 R, 301, 314

[56] References Cited

U.S. PATENT DOCUMENTS

| | | | |
|---|---|---|---|
| 1,047,951 | 12/1912 | Kenely | 126/301 |
| 1,433,247 | 10/1922 | Tiffany | 126/59 |
| 1,468,165 | 9/1923 | Moore | 126/59 |
| 2,962,021 | 11/1960 | Dumond | 126/59 |
| 3,815,572 | 6/1974 | Wolfe | 126/85 B |
| 4,069,806 | 1/1978 | Landry | 126/59 |
| 4,129,408 | 12/1978 | Hammar | 126/85 B |
| 4,306,491 | 12/1981 | Reardon, Jr. | 126/307 R |

*Primary Examiner*—James C. Yeung
*Attorney, Agent, or Firm*—Michael J. Tavella

[57] ABSTRACT

A lightweight, portable cooking unit for use in tents is disclosed. It is designed for use in the mountains, where lightweight equipment is essential. The unit will fit in a backpack when disassembled. The heating chamber has a lower burner unit to hold a common mountain stove burner such as those developed by MOUNTAIN SAFETY RESEARCH. The heating chamber vents to a stack that transmits the combustion gases and moisture safely outside the tent by means of a tent roof jack that protects the fabric from the heat. The stack is also fed with ambient air that mixes with the combustion to cool the exhaust to safe levels. The device can be disassembled and stored in a compact package.

2 Claims, 3 Drawing Sheets

BACKPACKING STOVE FOR TENT USE

This invention relates to stoves for tent use and more particularly to backpacking stoves for tent use.

BACKGROUND OF THE INVENTION

People have been using tents for as long as fabric has existed. Tents provide shelter in the outdoors and are most appreciated in bad weather. In rain, snow or wind, a tent can be a life saving shelter. One difficulty that has plagued tent use is the inability to easily and safely cook inside the tent. Being fabric, most tents are flammable. Thus, operating even a small stove inside a tent can be hazardous. Moreover, in high humidity or cold weather, the cooking process generates an enormous quantity of moisture, which can quickly soak the interior of a tent. Finally, stoves operated in a tent can generate excessive amounts of carbon monoxide which can be lethal. Thus, to provide a safe, practical means of cooking in a tent, two things are needed: first, some means to protect the fabric from the heat source. Second, a means is needed to safely and conveniently exhaust the excess heat, moisture and gases. Opening the tent doors in a gale is not a practical solution. Although this problem exists in all tents, it is especially so in modern backpacking tents. These tents are designed to be lightweight and are small. In winter conditions, two people in a tent might feel cramped. Cooking under these conditions is more difficult. Most often, campers are forced to cook outside the tent for safety and comfort.

Historically, people have designed systems for using common stoves in tents. These stoves use stacks that are passed through the walls or top of the tent using some type of modified "roof jack". Examples of this type of design are found in U.S. Pat. Nos. 513,586, 522,483, 1,064,610, 1,111,384, and 2,601,865. These devices are primarily stack systems designed for large tents and would be difficult to adopt to today's backpacking style, where weight of equipment is at a premium.

Several types of folding portable stoves have also been patented. Examples of these include U.S. Pat. Nos. 669,281, 2,798,476, 4,489,706, and 5,203,316. All of these stoves appear portable, but are not designed to be used in tents.

The present invention overcomes the problems of safe cooking and proper ventilation. It consists of a lightweight, portable unit that will fit in a backpack. It is designed for use in the mountains, where lightweight equipment is essential. It has a burner unit that holds a common mountain stove burner such as those developed by MOUNTAIN SAFETY RESEARCH, or other lightweight backpacking type stoves. This burner unit vents to a stack that transmits the combustion gases and moisture safely outside the tent by means of a tent roof jack that protects the tent fabric from the heat.

It is an object of this invention to produce a tent stove suitable for use in backpacking type tents.

It is another object of this invention to produce a stove for tents that is lightweight, portable, and easy to assemble.

It is yet another object of this invention to produce a stove for use in backpacking that is safe to use under adverse conditions.

DETAILED DESCRIPTION OF THE INVENTION

Figure 1:
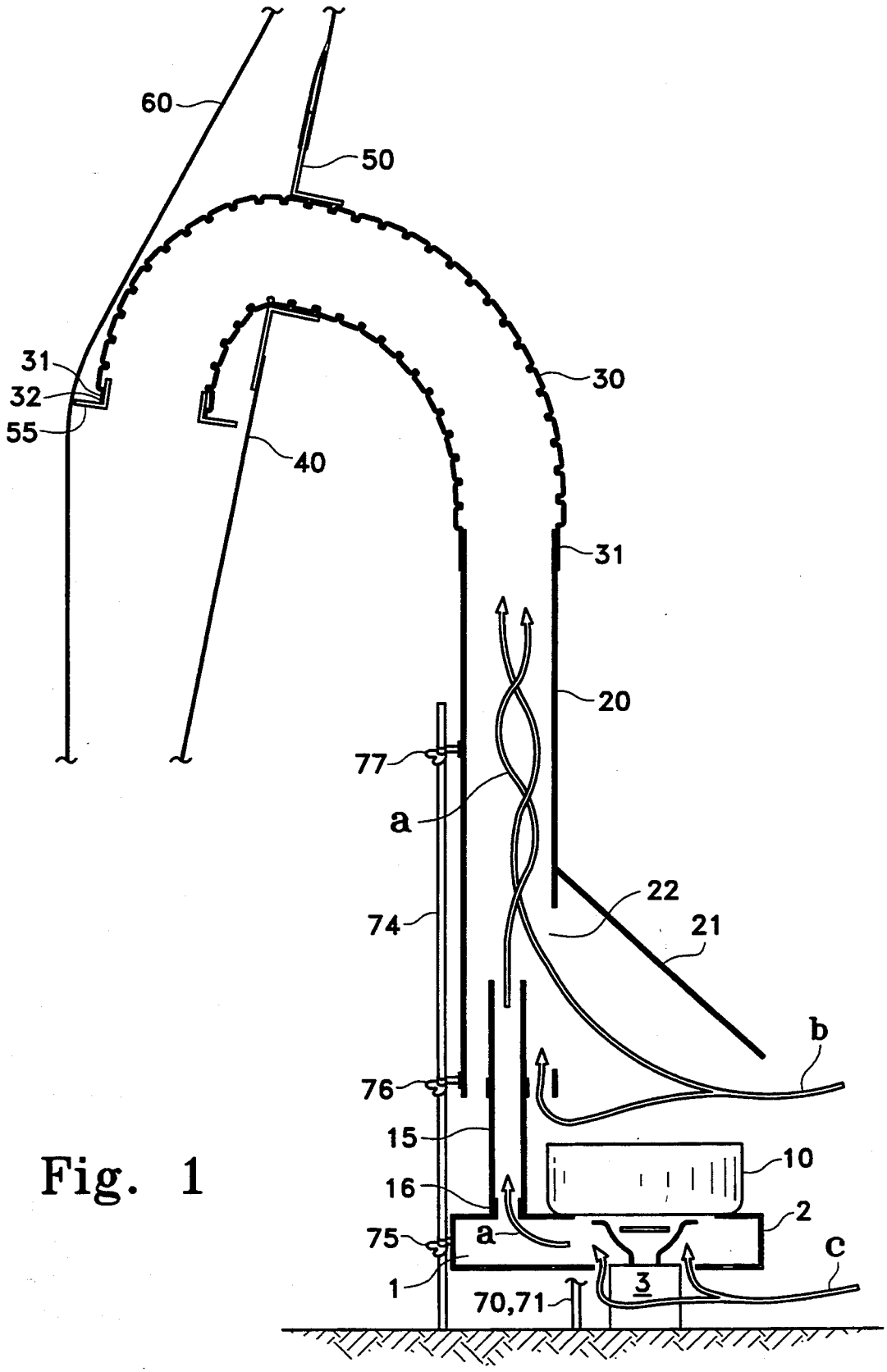
FIG. 1 is a cross-sectional view of the invention showing the flow of air and gases through the device.
Figure 2:
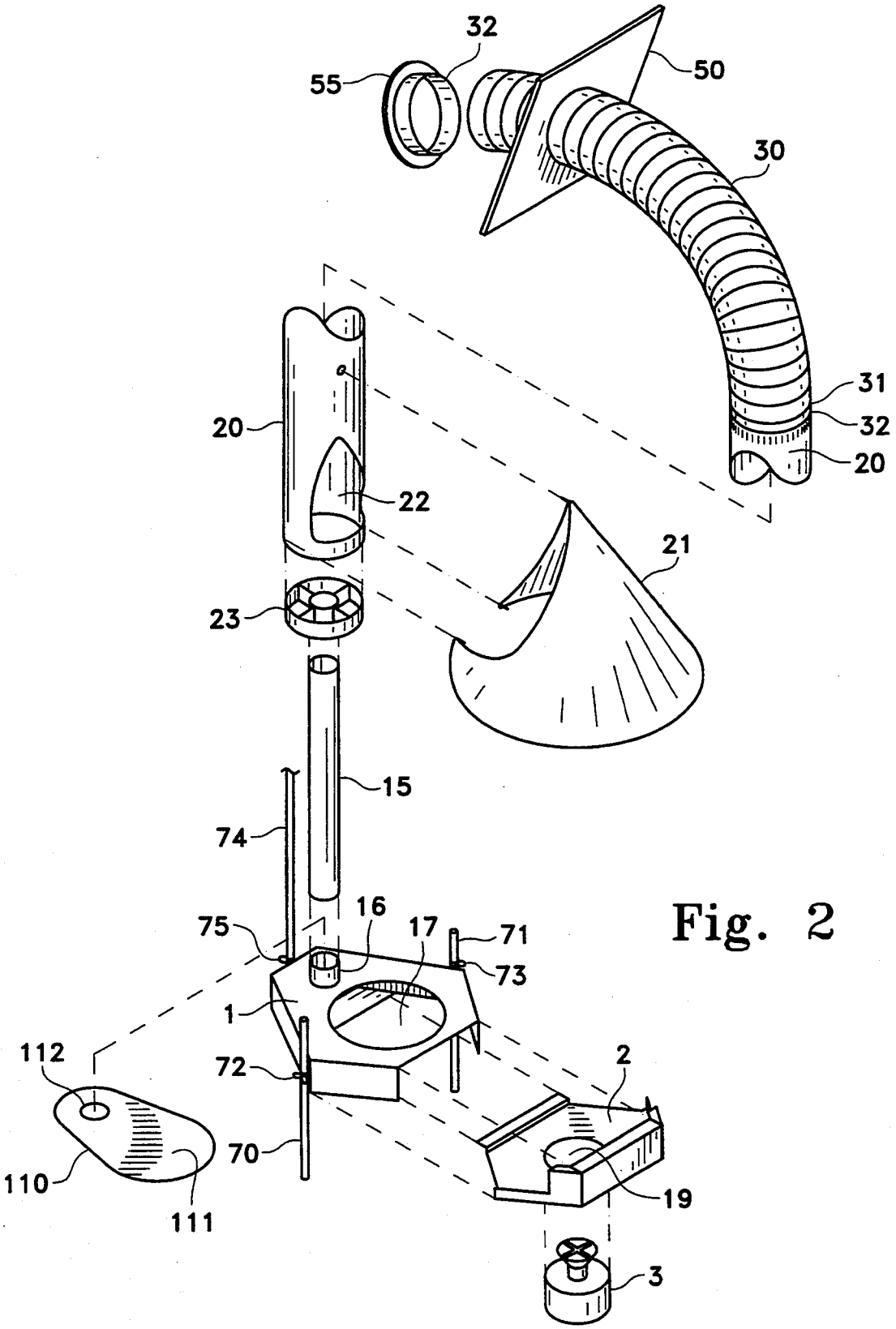
FIG. 2 is an exploded isometric view of the invention assembled for use with the camp stove installed.

Referring now to the drawings, and more particularly FIGS. 1 and 2, the device consists of a heating chamber and flue assembly. The burner unit has an heating chamber 1 and a sliding stove tray 2. The sliding stove tray holds a small, portable camp stove 3. In the preferred embodiment, the stove used is manufactured by MOUNTAIN SAFETY RESEARCH (MSR), a representative model of back packing stoves.

The stove 3 is placed on the sliding tray 2 and the tray is then slid into position under the heating chamber 1. The sliding tray 2 fits into slots within the heating chamber 1 and is held in place by friction. A pot 10 can be placed on the top of the heating chamber 1 as shown.

Heat is removed from the heating chamber 1 through the flue assembly. An inner flue 15 is attached to a small nipple 16 on the heating chamber 1 (see FIG. 2). The inner flue 15 transports the combustion gases (line a) from the heating chamber 1 to the stack 20. Stack 20 has a front hood 21. The combustion gases induce the flow of ambient air from the tent into the stack 20 through vent hole 22 (see line b, FIG. 1). Combustion air also enters the heating chamber 1 through the bottom of the chamber (see line c, FIG. 1). The combustion gases and ambient air mix in the stack 20. This mixing cools the combustion gases to a safe temperature.

A flexible exhaust hose 30 is attached to the top of the stack 20 as shown. A standard hose clamp 31 is used to hold the flexible stack in place. The flexible hose 30 serves two purposes. First, it can bend at different angles to permit installation in many different types of tents. Second, the flexible hose can be collapsed into a small package, which helps reduce the space needed for the device while maintaining the greatest amount of flexibility in installing the stack assembly.

The flexible exhaust hose 30 passes through the tent wall 40 using a metal tent jack 50 to prevent overheating of the fabric. The metal jack 50 consists of a metal plate that fits into a special pocket sewn into the tent fabric. See FIGS. 3 and 4. Typically, the flexible exhaust hose 30 will be placed under the waterproof rain fly 60 of the tent. See also, FIG. 1. FIG. 2 shows an isometric detail of the flexible exhaust hose 30. The hose has an end flange 31 and a hose clamp 32, for connection to the stack, and a discharge flange 55. This permits the flexible hose to be removed and installed easily. Discharge flange 55 is intended to hold the tent 40 and tent fly 60 apart. Thus eliminating contact with the flexible exhaust hose discharge. See FIG. 1.

Figure 3:
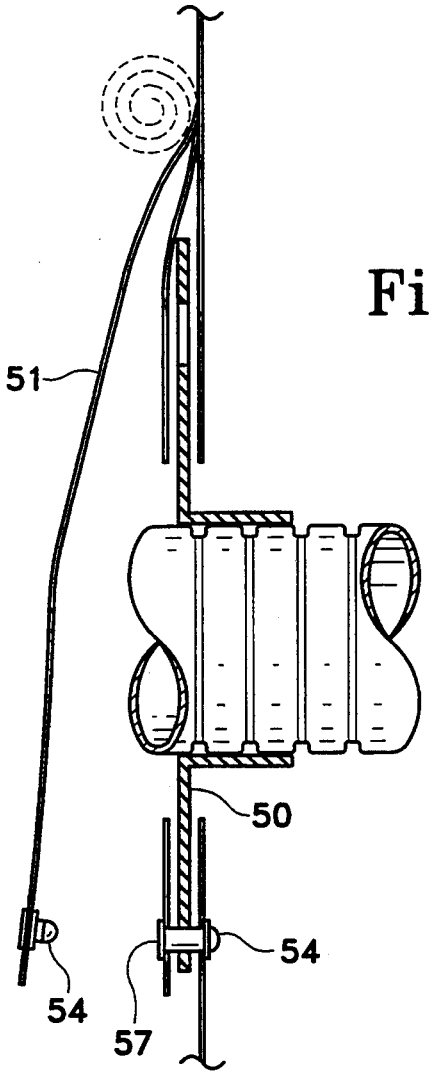
FIG. 3 is a detail of the flexible exhaust house passing through a tent wall.
Figure 4:
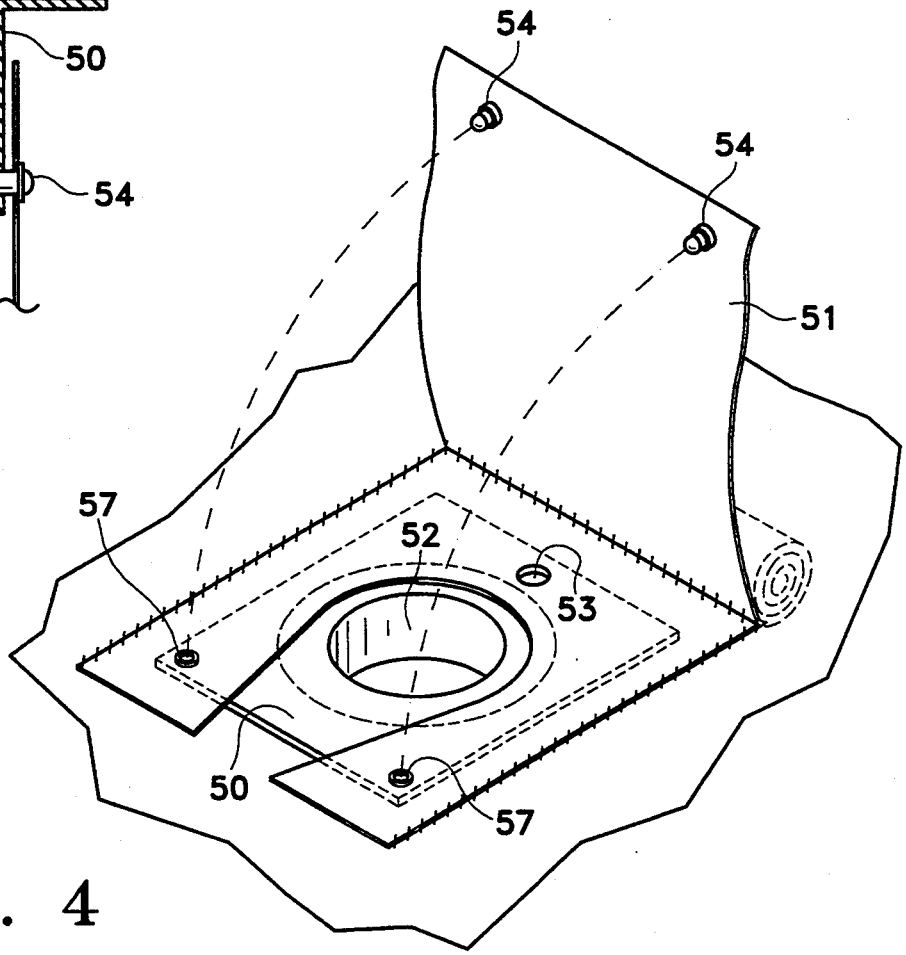
FIG. 4 is a detail of the exhaust port cover operation.

The metal tent jack 50 (see FIG. 2) is designed to shield the tent fabric from the heat of the stack. This type of jack is typical of tent jacks found in earlier designs. FIGS. 3 and 4 illustrate the method of installation of the roof jack on the tent wall. For convenience, the jack can be mounted into a frame 56 sewn into the tent wall. A cover 51 can be placed over the jack 50 on outside of the wall to cover the jack 50 when the stove is not in use. In the preferred embodiment, the jack has two holes 52 and 53 as shown in FIG. 2. Hole 52 permits the jack to be slid down over the stack for storage. Hole 53 is designed to fit over the nipple 16, mounted on the heating chamber 1. Securing the jack on the nipple is an alternative storage means. The jack 50 has two additional holes 57 that correspond to snaps 54 that are attached to the cover 51. These snaps 54 secure the cover 51 over the roof jack opening, when the stove is not used (see FIG. 4). The portion of snaps 54 mounted into the tent fabric also are used to hold the roof jack 50 in place (see FIG. 3) by fitting the snap hardware through holes 57.

The device is supported by three metal legs. Two short legs 70 and 71 are attached to the sides of the heating chamber 1 using bracket assemblies 72 and 73. The rear leg 74 is long and is used to support the stack 20. Bracket assembly 75 is attached to the back of the heating chamber 1. Bracket assemblies 76 and 77 are attached to the stack 20. All of the bracket assemblies each consist of a bracket and a set screw. The leg passes through the bracket and is held firm by tightening the set screw against the mounting surface. This support method is simple to use, assembles quickly, and is readily adjustable to accommodate uneven ground surfaces.

Referring now to FIG. 2, details of the specific components will be provided. Stack 20 is typical cylindrical sheet metal stack. The top 21 of the stack 20 is crimped to permit easy assembly to the flexible exhaust hose 30. Vent opening 22 is shown placed in the side of the stack 20. The back of the stack 20 is fitted with bracket assemblies 76 and 77 as discussed above.

Flue pipe 15 is essentially a cylinder having an open top and bottom it is smaller in diameter than the stack 20. The flue pipe has an overall length that reaches from the top of the heating chamber 1 to the center of vent hole 22. It is held in place by passing the cylinder through the alignment guide 23, secured to the bottom of 20.

Heating chamber 1 is fashioned from light weight sheet metal that can handle high temperatures. The shape of the heating chamber 1 is designed to provide optimum heating area in a compact form that can efficiently exhaust the combustion gases of the stove. To accomplish this, the heating chamber 1 is formed as a modified hexagon. The heating chamber 1 has sides that extend downward (see e.g., FIG. 2). The top and side walls of the heating chamber 1 form a heat chamber that focuses the heat on the cooking pot 10 (see FIG. 1) as well as providing a plenum for exhausting the combustion gases (see FIG. 1). A large hole 17 is cut into the top of the heating chamber 1 as shown. This permits the heat of the camping stove to directly heat a cooking pot 10. An exhaust nipple 16 is attached to the top of the heating chamber 1. The nipple 16 opens into the plenum and is used to direct gases from the chamber into the flue 15. Three brackets 72, 73, and 75 are attached to the sides of the heating chamber 1 as shown. These brackets are designed to hold the legs, as discussed above.

Some models of portable gasoline powered camping stoves require priming. This results in large flare-ups from the stove. In this case, the stove 3 must be primed outside the tent. After the flare-ups have subsided, the lighted stove may be placed in the stove tray 2. The stove tray 2 fits under the heating chamber 1, and is designed to fit into channels formed within the heating chamber 1 such that the stove tray 2 can be pulled outward to insert or remove the stove. FIG. 1 shows the tray 2 in place for use. FIG. 2 shows the tray 2 in its pulled out position for inserting or removing the stove 3. The tray has a flat circular area 19 that holds the stove in a flat position for use.

FIG. 2 shows a removable stove pot pad 110. It has a heat resistant surface 111 designed to cover the stove hole 17. It also has a hole 112 that is designed to fit over the nipple 15. This permits the pad to be rotated around the flue pipe 15 as needed for access to the stove.

TESTS

Tests of the device were conducted in a tent in which the ambient air temperature was 70 degrees F. At such conditions, an MSR stove produced mixed combustion gases at 200 degrees F in the stack. This temperature is low enough to prevent damage to the tent or the rain fly (note: all materials can be obtained, including commercial tents that have temperature ratings in excess of 250° F.) at ambient temperatures below 70° F., the exhaust gases will be cooler than 200° F. Typically, this device would be used in ambient temperatures much below 70° F. as it is intended for mountainous and high altitude use.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A portable backpack stove with exhaust comprising:

a) a tent having walls;

b) a heating chamber, said heating chamber having a top, said top having an opening to conduct heat to a cooking pot, said heating chamber also having a nipple fixedly placed on said top to permit the flow of combustion gases from said heating chamber through said nipple, said heating chamber having a hexagonal shape;

c) means to support said heating chamber;

d) portable camp stove means, removably placed within said heating chamber;

e) flue means, removably attached to said nipple on said heating chamber to vent combustion gases from the heating chamber;

f) a stack, said stack having a lower stack portion being cylindrical and non flexible, an upper stack portion that is flexible, and means to connect said upper stack and said lower stack to form a single unit, said stack being removably installed above said flue means such that said stack receives said combustion gases from said flue, said stack further having an opening cut into said lower stack portion to permit the entry of ambient air into said stack;

g) hood means removable placed over said opening in said stack to direct the flow of ambient air to said opening;

h) means to support said stack above said flue;

i) a metal roof jack slidably attached to said flexible upper portion of said stack, to permit the flexible upper portion of said stack to pass through the tent wall; and j) means to secure said roof jack to said tent wall.

2. The portable backpack stove with exhaust of claim 1, wherein the components of said stove can be disassembled for storage.

* * * * *